US005251772A

United States Patent [19]

Toguchi

[11] Patent Number: 5,251,772

[45] Date of Patent: Oct. 12, 1993

[54] DOCUMENT FILING CASE

[76] Inventor: Yoshiaki Toguchi, 3-18-8 Makiminato, Urasoe-Shi, Okinawa-Ken, Japan

[21] Appl. No.: 967,497

[22] Filed: Oct. 28, 1992

[51] Int. Cl.[5] ..... B65D 6/18; B65D 6/26

[52] U.S. Cl. ..... 220/6; 220/7; 206/504; 206/511

[58] Field of Search ..... 220/6, 7, 4.28, 1.5, 220/666; 206/509, 511, 512, 504; 217/15, 13, 47, 45

[56] References Cited

U.S. PATENT DOCUMENTS

| | | | |
|---|---|---|---|
| 1,427,766 | 9/1922 | Adams | 220/6 |
| 2,539,260 | 1/1951 | McCurdy | 217/47 |
| 2,782,955 | 2/1957 | Gordon | 220/6 |
| 2,934,389 | 4/1960 | Krey | 220/6 |
| 3,799,384 | 3/1974 | Hurkamp | 220/6 |
| 4,398,653 | 8/1983 | Daloisio | 206/512 |
| 4,630,745 | 12/1986 | Shiotani | 217/15 |
| 4,630,747 | 12/1986 | Chiang et al. | 217/47 |
| 4,726,486 | 2/1988 | Masuda | 220/6 |
| 4,798,304 | 1/1989 | Rader | 220/6 |
| 5,036,979 | 8/1991 | Selz | 206/512 |

FOREIGN PATENT DOCUMENTS

| | | | |
|---|---|---|---|
| 2410604 | 8/1979 | France | 220/6 |

*Primary Examiner*—Gary E. Elkins
*Assistant Examiner*—S. Castellano
*Attorney, Agent, or Firm*—Edwin E. Greigg; Ronald E. Greigg

[57] ABSTRACT

In accordance with this invention, in order that a document filing case can be piled on another document filing case in a folded state before use and can be constituted as a box with ease in use, a document filing case comprises: an upper wall member having one end portion pivotally connected to the front frame member, and the other end portion guided into longitudinal grooves formed in the rear frame member; a bottom wall member having one end portion pivotally connected to the rear frame member so as to oppose the upper wall member and the other end portion guided into longitudinal grooves formed in the front frame member; left and right side walls pivotally connected to either the upper wall member or the bottom wall member so that these side walls can rotate in a vertical direction from a folded state when the bottom wall member and the upper wall member rotate so that they are opposite to each other in a horizontal state; a rear wall attached on the rear frame member; and a front wall pivotally connected to the front frame member so that it can be opened and closed.

2 Claims, 13 Drawing Sheets

DOCUMENT FILING CASE

BACKGROUND OF THE INVENTION

This invention relates to a document filing case utilized in the case of keeping documents in order in the State organs, organs of To, Do, Fu and Prefectures, the local self-govering bodies, the research material services, enterprises, offices or the like.

Heretofore, in the case of keeping in order documents such as important materials or data, official documents or case documents, etc. in the State organs, the organs of To, Do, Fu and Prefectures, or offices, or the like, e.g., filing methods of keeping documents in order as described below were adopted:

(1) Filing method of piling documents on a shelf leaving the documents as they are so that they are put in order.

(2) Filing method of inserting documents into files or a case files to put them in order on a suitable filing cabinet.

Meanwhile, in the case where documents to be preserved increase year by year, such filing methods as described above have the problem that it is not easy to put documents in order, it is impossible to easily select a desired document or documents, and it is impossible to easily move a desired document to a desired portion when a document is desired to be moved. Particularly, when attention is made to the documents filing cabinet in the State organs, the organs of To, Do, Fu and Prefectures, the local self-govering bodies, research material services, or the like, documents of respective departments or bureaus are put in disorder or in confusion. Since the condition for putting documents in order is not necessarily good, the work for putting documents in order is very troublesome.

As a part of projects or planes for keeping in order documents such as important materials or data, official documents or case documents, etc., a document filing case which fully satisfies the filing condition (i.e., condition for keeping documents in order) is expected.

SUMMARY OF THE INVENTION

With the above in view, an object of this invention is to provide a document filing case which can be stacked on another document filing case in a folded state at a suitable place so as not to take a space before use, which can be assembled with ease from the folded state to the state of a box in use, which can sufficiently satisfy the filing condition during use, and which can easily move a desired document to a desired place at any time.

BRIEF DESCRIPTION OF THE DRAWINGS

In the drawings:

FIG. 1 is an explanatory view presented as a perspective view;

FIG. 2 is a perspective view showing that this document filing case is placed in a box state.

FIG. 3 is an enlarged cross sectional view taken along the line 3—3 of FIG. 4;

FIG. 4 is a front view showing that the document filing case is in a box state;

FIG. 5 is a plane view showing that the document filing case is in the box state;

FIG. 6 is a right side cross sectional view showing that the document filing case is in the box state;

FIG. 7 is a perspective view showing that the document filing case is in a folded state;

FIGS. 8 to 10 are explanatory views in the case where the document filing case is formed from a folded state to a box state;

FIG. 11 is an explanatory view of the essential part; and

FIGS. 12 and 13 are explanatory views showing the state where a plurality of document filing cases are connected.

DESCRIPTION OF THE PREFERRED EMBODIMENT

Figure 1:
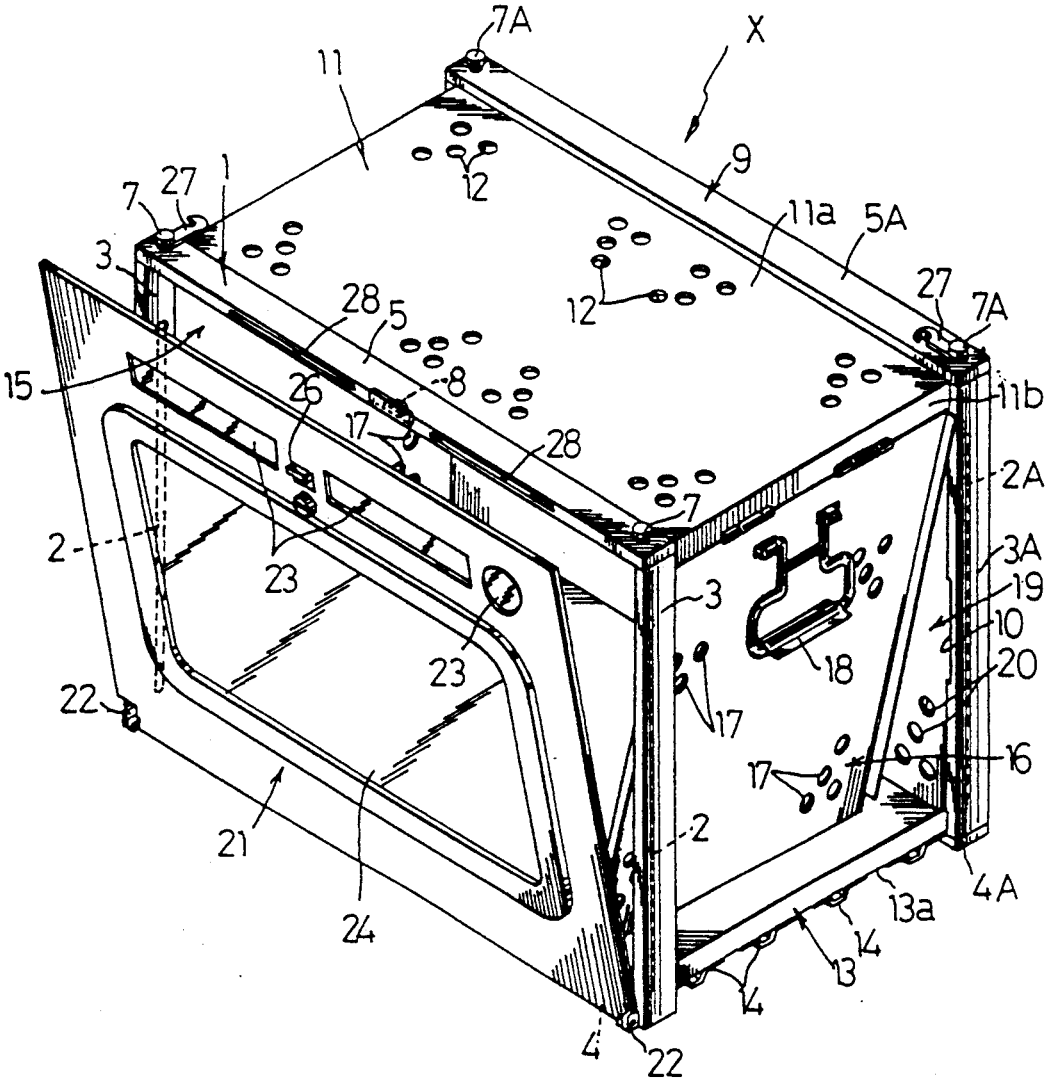
FIGS. 1 to 13 are explanatory views showing an embodiment of this invention.

This invention will now be described in detail in connection with an embodiment shown.

Reference symbol X denotes a metallic document filing case which can be formed from a folded state to a state of box. Reference numeral 1 denotes a rectangular front frame member. This front frame member 1 comprises a pair of left and right side wall portions 3, 3 where longitudinal grooves 2, 2 are respectively formed at the inner wall surfaces thereof, a bottom wall portion 4 connected in a direction of a right angle at the lower end portions of these side wall portions 3, 3, and an upper wall portion 5 connected in a direction of a right angle at the upper end portions of the side wall portions 3, 3 so as to oppose the bottom wall portion 4.

Engagement holes 6, 6 are formed at the both end portions of the bottom wall portion 4 of the front frame member 1. On the other hand, engagement projections 7, 7 adapted to be fitted into these engagement holes are respectively provided at the both end portions of the upper wall portion 5 (It is to be noted that those engagement projections are adapted to be fitted into engagement holes of the frame member of another document filing case X which is to be piled). In addition, a lock groove 8 adapted for engaging with a lock piece which will be described later is formed at the inner wall surface at the central portion of the upper wall portion 5 of the front frame member 1.

On the other hand, reference numeral 9 denotes a rectangular rear frame member opposite to the front frame member 1. Since this rear frame member 9 is formed so that it is substantially identical with the front frame member 1, similar reference numerals are respectively attached to the same portions, and their repetitive explanation will be omitted.

Namely, reference numeral 2A denotes longitudinal grooves formed at respective side wall portions 3A, reference numeral 4A denotes a bottom wall portion having engagement holes 6A, 6A, and reference numeral 5A denotes an upper wall portion having engagement projections 7A, 7A. It is to be noted that while the rear frame member 9 has not lock groove at the upper wall portion 5A as in the front frame member 1, notched or cut portions 10, 10 into which knobs which will be described latter are fitted are formed at the central portions of the inner wall surfaces of the left and right side wall portions 3A and 3A, respectively. It should be noted that notched or cut portions are also formed at the left and right side wall portions 3, 3 of the front frame member 1.

Reference numeral 11 denotes an upper wall member having one end portion pivotally connected (or hinged) to the upper end portion of the side wall portion 3 of the front frame member 1 and the other end guided into the longitudinal grooves 2A of the side wall portions 3A of the rear frame member 9. This upper wall member 11 is formed channel shaped in cross section, and a large number of penetration holes 12 are provided at an upper wall portion 11*a*.

Reference numeral 13 denotes a bottom wall member having one end portion pivotally connected to the lower end portions of the rear frame portions 3A so as to oppose the upper wall member 11, and the other end portion guided into the longitudinal grooves 2 of the side wall portions 3 of the front frame member 1. This bottom wall member 13 is formed channel-shaped in cross section similarly to the upper wall member, and a plurality of mountain-shaped reinforced pieces 14 are affixed at a required interval on the lower surface of a bottom wall portion 13*a*.

Reference numerals 15, 16 denote left and right side walls pivotally connected to either the upper wall member 11 or the bottom wall member 13 so that the bottom wall member 13 and the upper wall member 11 can rotate in a vertical direction from a folded state when these members rotates so that they are opposite to each other in a horizontal or parallel state. These left and right side walls 15 and 16 are pivotally connected to left and right vertical portions 11*b* of the upper wall member 11 in this embodiment, respectively. In addition, a large number of penetration holes 17 are formed in the left and right side walls 15 and 16 similarly to the upper wall member 11.

Reference numeral 18 denotes a pair of knobs rotatably provided at portions close to the pivotally connected portions of the left and right side walls 15 and 16.

Reference numeral 19 denotes a rear wall fixedly affixed to the rear end surface of the rear frame member 9, and a large number of penetration holes 20 are also formed in the rear wall 19.

Reference numeral 21 denotes a front wall or opening and closing door pivotally connected to the front end surface of the front frame member 1 so that it can be opened and closed. This front wall 21 is pivotally connected to the lower end portions of the left and right side wall portions 3, 3 of the front frame member 1 through a pair of left and right pivot pieces 22, 22 in this embodiment.

Thus, a plurality of index card accommodation portions 23 having a transparent glass are formed at the upper portion of the front wall 21, and a relatively large transparent glass 24 is provided at the cental portion of the front wall 21. Further, a lock piece 26 biased in one direction at all times by a spring member 25 and adapted to be capable of engaging and disengaging with the lock groove 8 of the previously described front frame member 1 is provided at a suitable portion, i.e., at the central portion in this embodiment of the upper part of the front wall 21.

Figure 12:
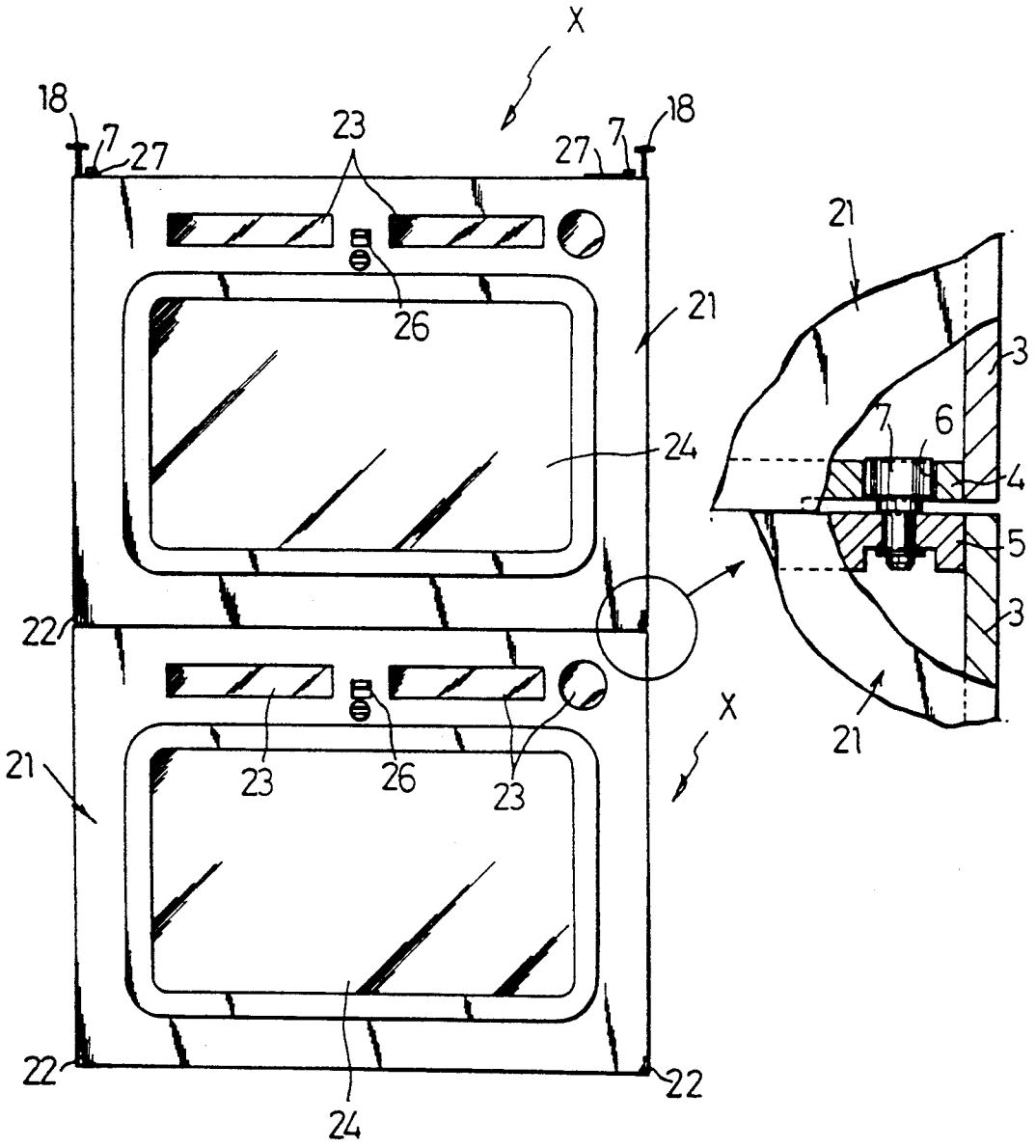
Figure 13:
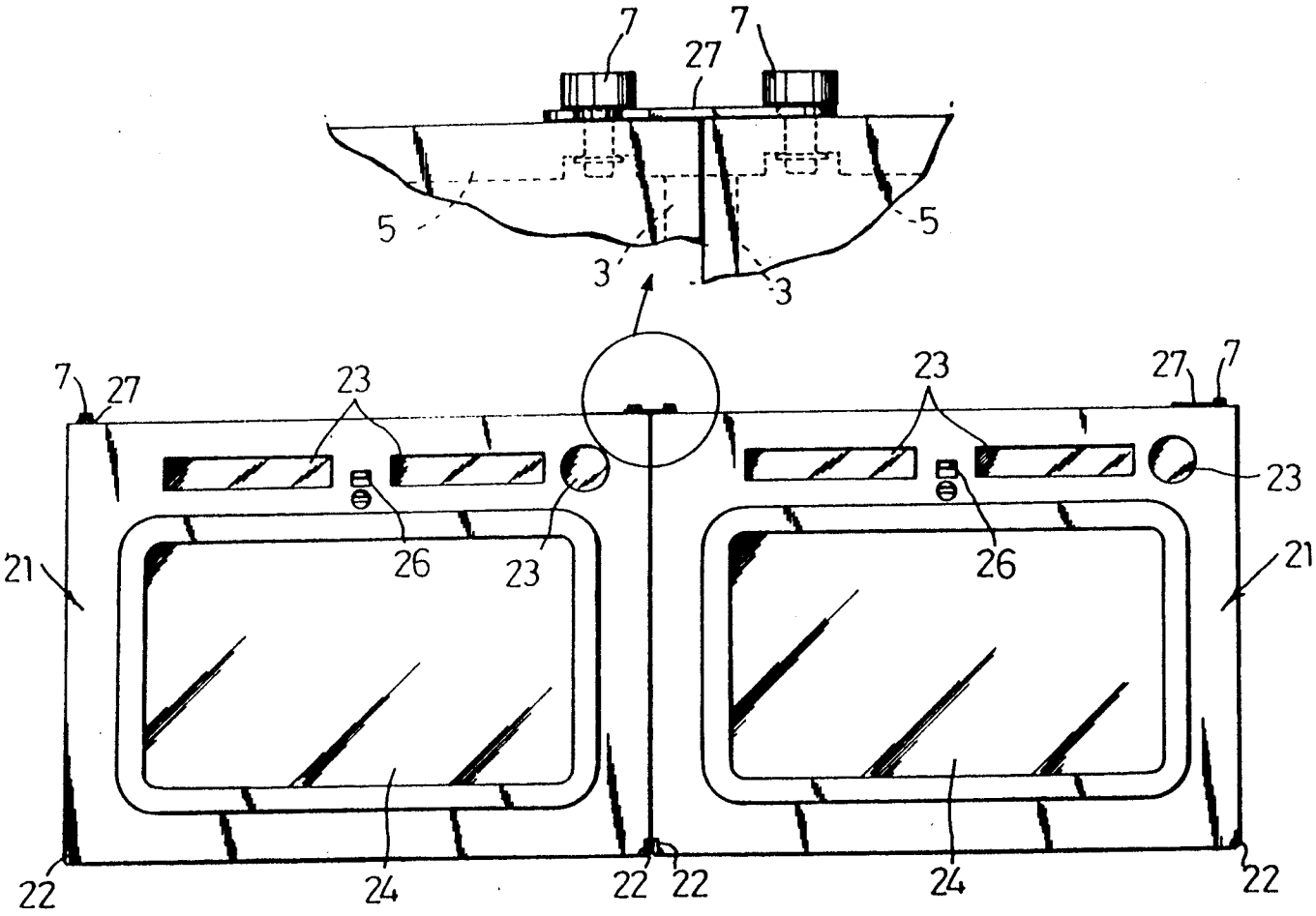

Reference numeral 27 denotes hook-shaped engagement pieces rotatably attached to engagement projections 7, 7A of the front and rear frame members 1, 9. These engagement pieces 27 are engaged with engagement projections 7, 7A of document filing cases adjacent to each other when the same document filing cases X are laterally arranged as shown in FIG. 12 to fixedly connect a plurality of document filing cases. Further, these projection pieces 27 are engaged with the opposite engagement projections when the front and rear frame members 1 and 9 are folded so that they are in a connected state.

Reference numeral 28 denotes a plurality of magnetic bodies embedded in recessed portions at the front surface of the upper wall portion 5 of the front frame member 1. These magnetic bodies 28 are adapted so that such magnetic bodies and the metal front wall 21 are magnetically connected to each other.

Figure 7:
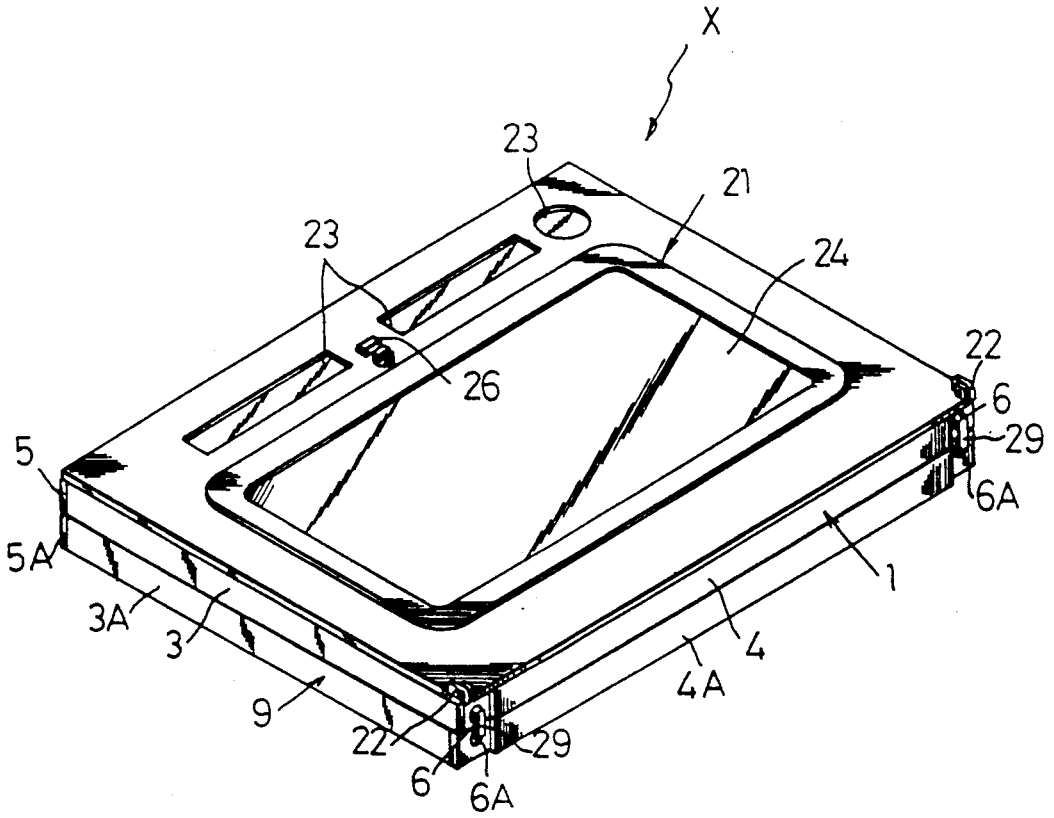

Additionally, reference numeral 29 denotes channel-shaped connecting pieces fitted into respective engagement holes 6 and 6A of the front and rear frame members 1 and 9 when the document filing case X is collapsed or folded so that it becomes compact as shown in FIG. 7.

Figure 2:
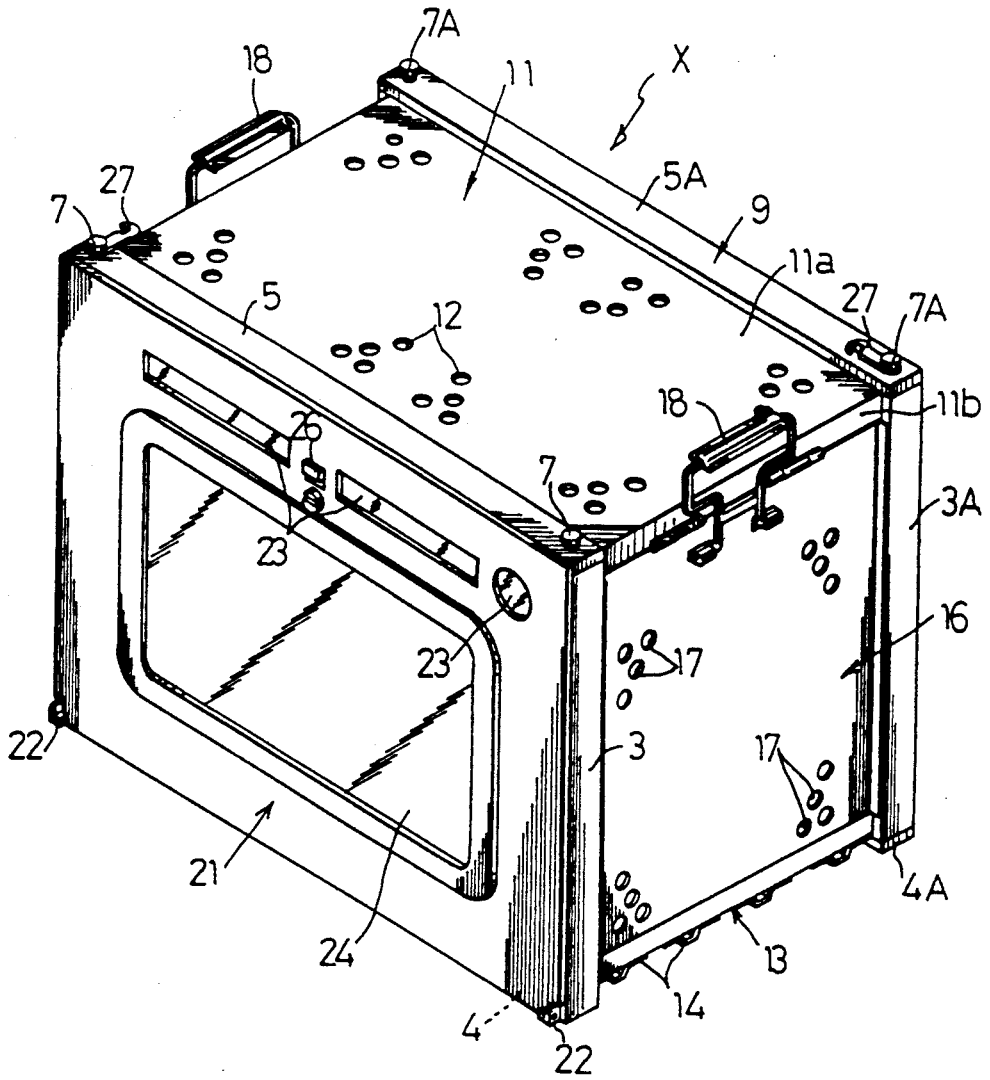
Figure 3:
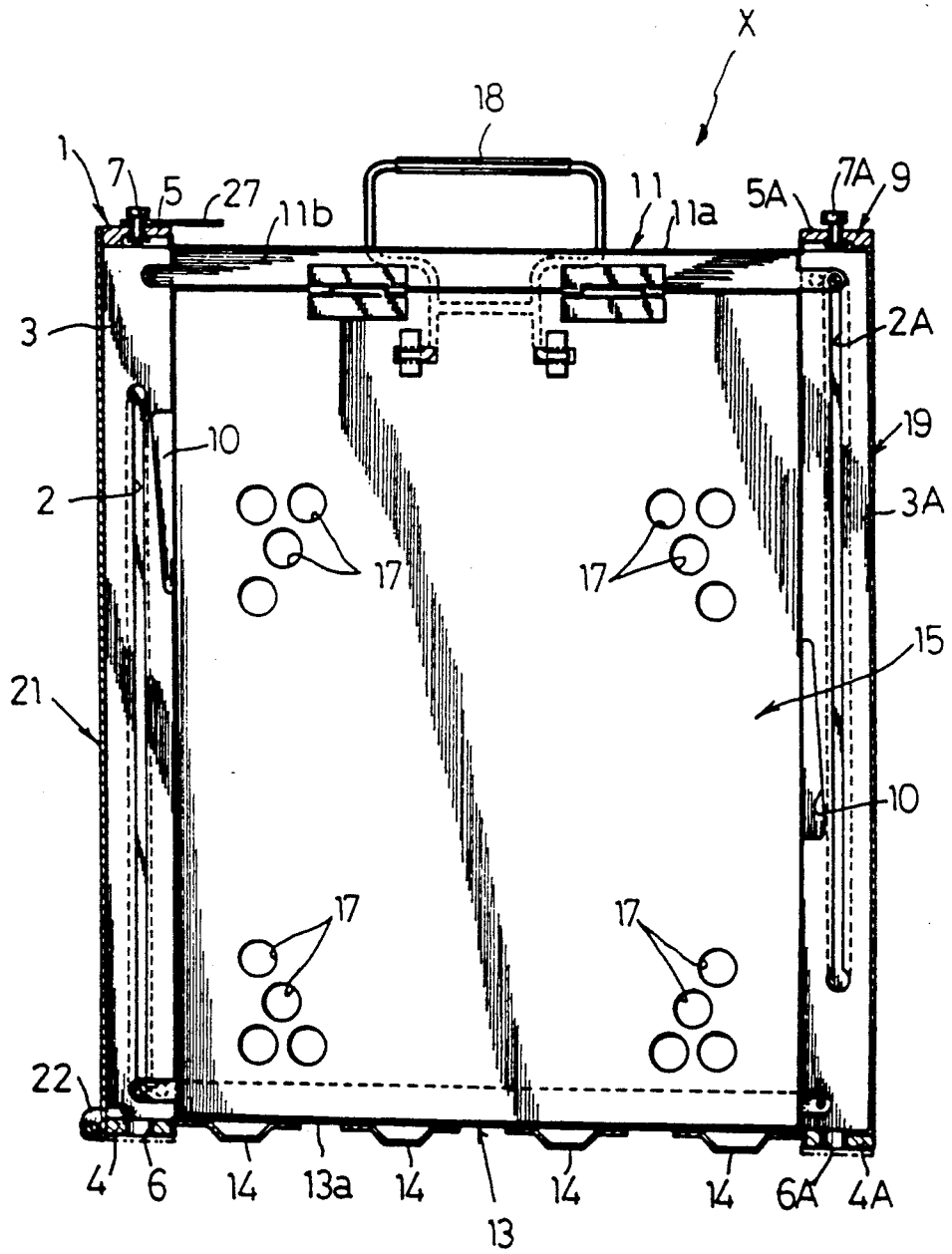
Figure 4:
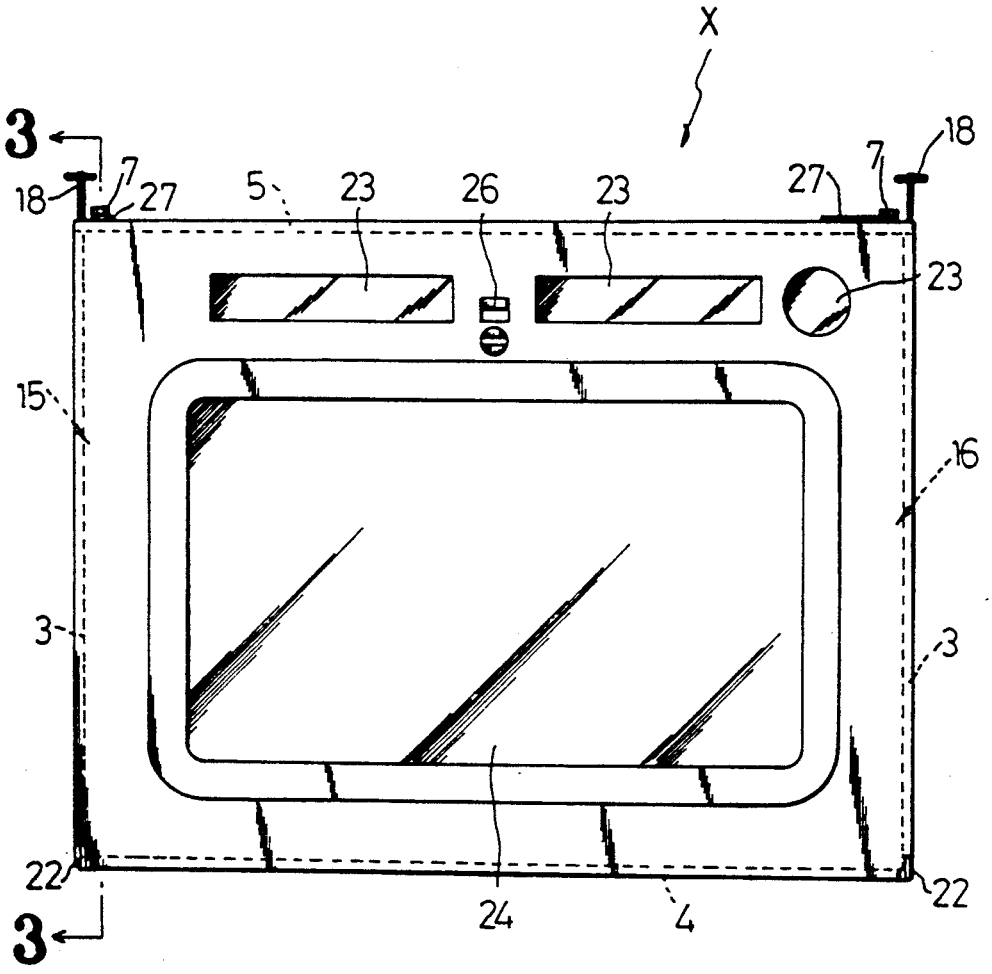
Figure 5:
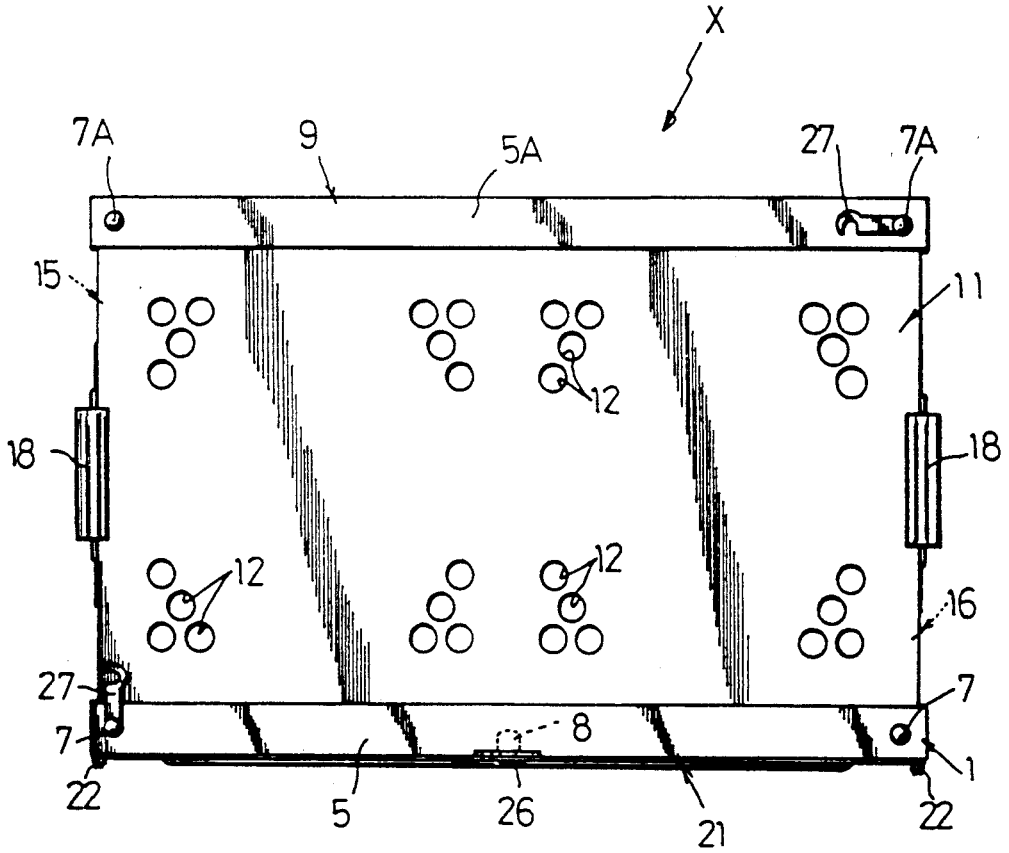
Figure 6:
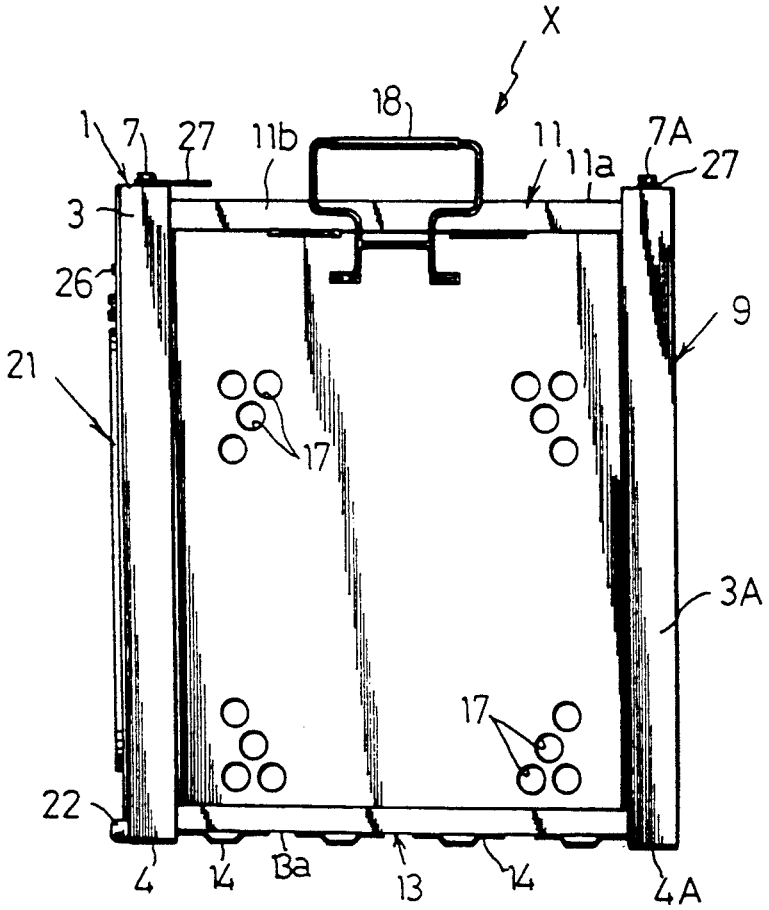

In the above configuration, explanation will be given in connection with the case where document filing case X is assembled from the folded state shown in FIG. 7 to the state of the box shown in FIG. 2.

Figure 8:
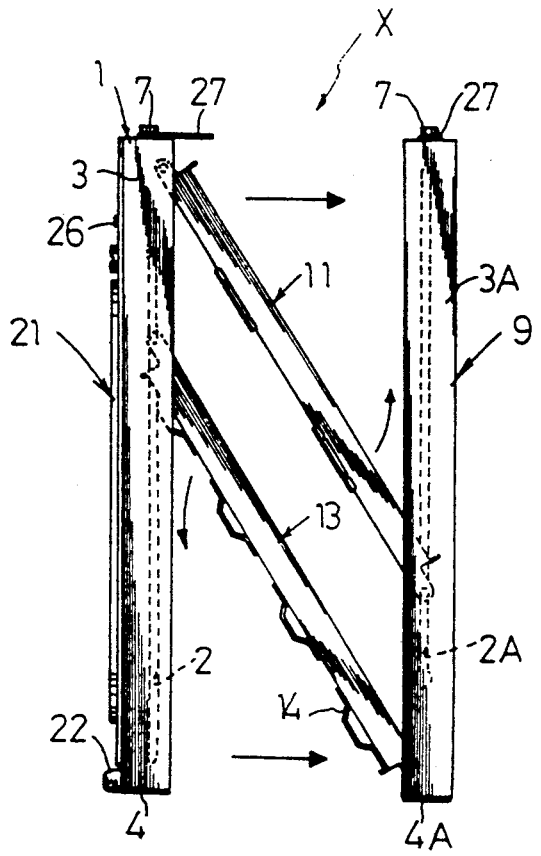
Figure 9:
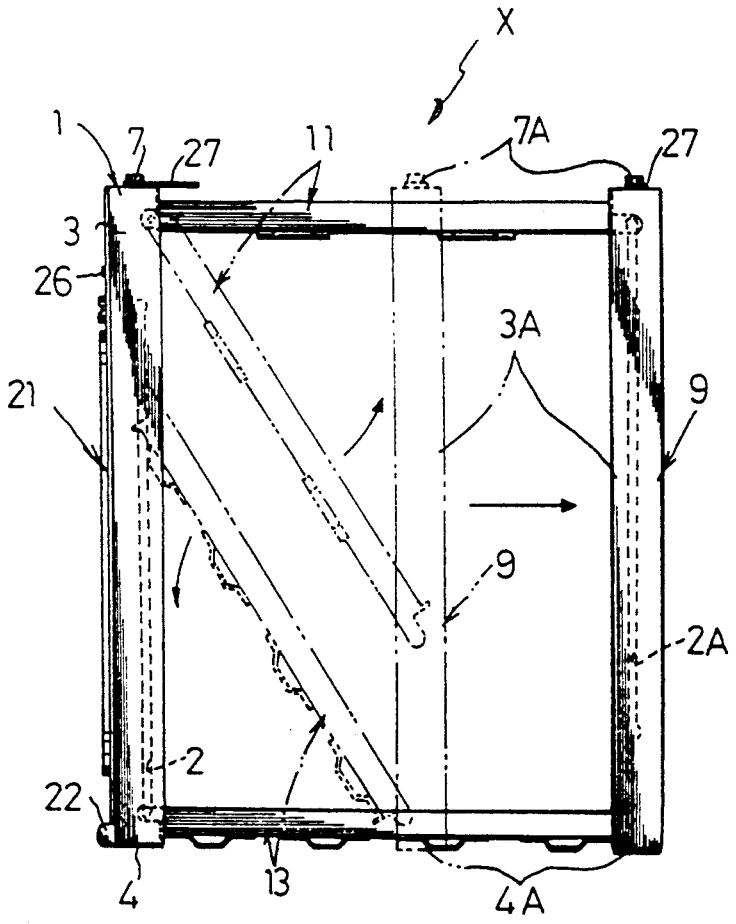
Figure 10:
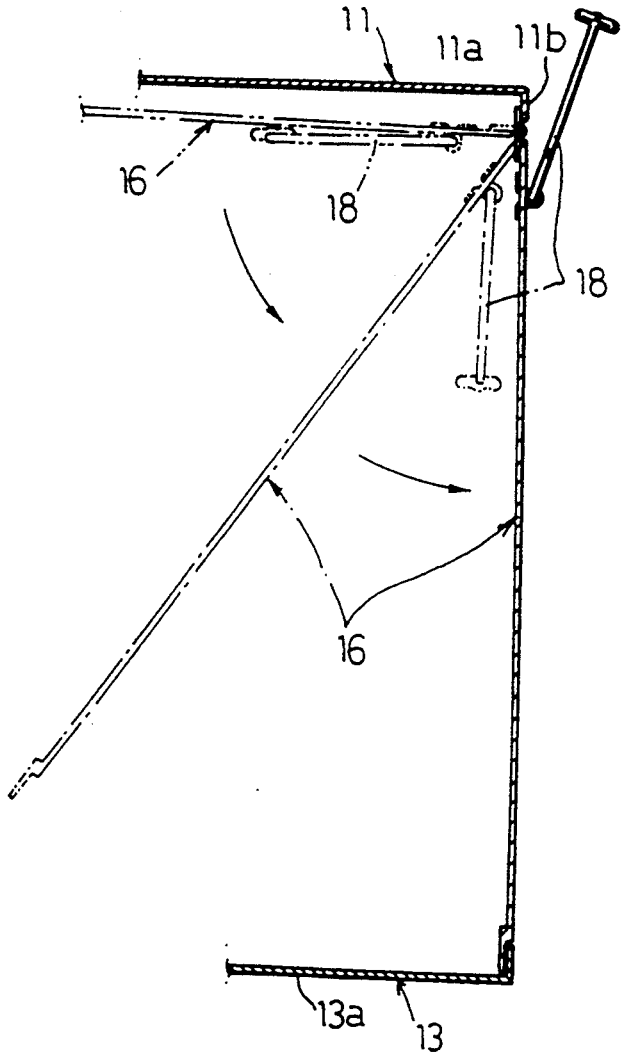

First, the engagement pieces 27 are disengaged from the opposite engagement projections, and the connection pieces 29 are detached from the engagement holes 6 and 6A. Thereafter, the front and rear frame members 1 and 9 are caused to be away from each other as shown in FIG. 8. At this time, the other end portion of the upper wall member 11 is guided into the longitudinal grooves 2A, 2A of the rear frame member 9, and the other end portion of the bottom wall member 13 is guided into the longitudinal grooves 2, 2 of the front frame member 1. As a result, the upper and lower wall members 1 and 9 respectively rotate by 90 degrees in a horizontal direction with their one end portions thereof being as a fulcrum.

When the upper wall member 11 and the bottom members 13 are opposite to each other in a horizontal state, the left and right side walls 15 and 16 are caused to rotate in a direction of a right angle from the folded state.

Thus, when the upper wall member 11 and the bottom wall member 13 are opposite to each other in a horizontal direction, they are fixedly held or retained by the front and rear frame members 1 and 9. On the other hand, when the left and right side walls 15 and 16 are vertically opposite to each other, they are fixedly held or retained by the bottom wall member.

Figure 11:
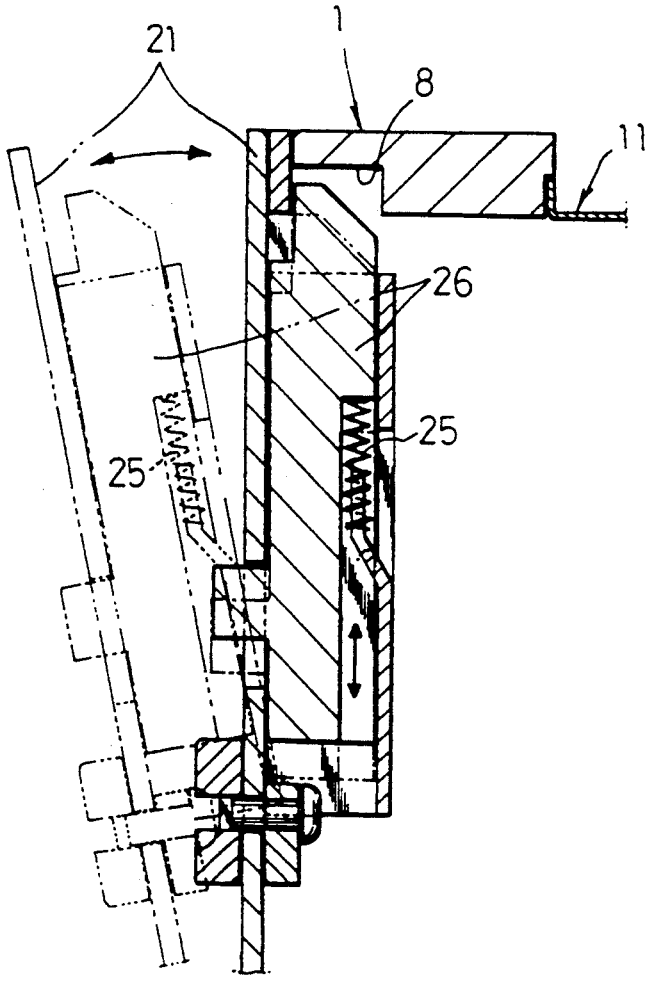

When the document filing case X is completed in this way, it is possible to accommodate or insert documents within the filing case X by operating the lock piece 26 to open the front wall 21. User can move or carry the document filing case to a desired portion by making use of the knobs 18. Further, a plurality of filing cases X can be fixedly connected in upper and lower directions as shown in FIG. 11 by the engagement relationship between the engagement holes 6, 6A and the engagement projections 7, 7A. In addition, a plurality of document filing cases X can be fixedly connected in left and right directions as shown in FIG. 12 by the engagement relationship between the projection pieces 27 and the engagement projections 7, 7A.

As is clear from the foregoing description, in accordance with this invention, a document filing case can be piled on another document filing case in a folded state at a suitable portion so as not to take a space before use. On the other hand, in use, the document filing case can be assembled with ease from a folded state to the state of box. In addition, during use, this filing case can sufficiently satisfy the condition required for keeping documents in order and it is possible to easily move a desired document to a desired portion at any time by making use of this document filing case.

What is claimed is:

1. A document filing case comprising: opposite rectangular front and rear frame members; an upper wall member having a first end portion pivotally connected to the front frame member and a second end portion guided into a longitudinal groove formed in the rear frame member; a bottom wall member having a third end portion pivotally connected to the rear frame member so as to oppose the upper wall member and a fourth end portion is guided into a longitudinal groove formed in the front frame member; left and right side walls pivotally connected to the upper wall member so that said left and right side walls can rotate to a vertical position from a folded state when the bottom wall member and the upper wall member rotate about a hinge so that said bottom and upper wall members are opposite to each other and in a horizontal position; a rear wall attached on the rear frame member; and a front wall pivotally connected to the front frame member so that said front wall can be opened and closed when said document case is in an erected state; engagement holes respectively formed in a bottom wall portion of each of said front and rear frame members; engagement projections formed in the upper wall portions of the front and rear frame members are adapted to be fitted into engagement holes of a front and rear frame member of another document filling case; and hook-shaped engagement pieces are rotatably attached to engagement projections of the front and rear frame members.

2. A document filing case as set forth in claim 1, wherein knobs are rotatably provided at said left and right side walls, respectively.

* * * * *